United States Patent [19]

Waldhofer

[11] 4,094,470

[45] June 13, 1978

[54] COMMINUTOR FOR USE IN A GASIFYING INSTALLATION

[75] Inventor: Reinhard Waldhofer, Essen, Germany

[73] Assignee: Krupp-Koppers GmbH, Essen, Germany

[21] Appl. No.: 764,453

[22] Filed: Jan. 31, 1977

[30] Foreign Application Priority Data

Feb. 2, 1976 Germany ..... 2606039

[51] Int. Cl.[2] ..... B02C 23/36

[52] U.S. Cl. ..... 241/46 R; 241/46.02

[58] Field of Search ..... 241/46 R, 46.02, 46.06, 241/46.25

[56] References Cited

U.S. PATENT DOCUMENTS

| | | | |
|---|---|---|---|
| 1,620,838 | 3/1927 | Seigle et al. | 241/46.02 |
| 2,280,944 | 4/1942 | Foresman | 241/46 R |
| 2,306,926 | 12/1942 | Allen | 241/46 R |
| 2,358,736 | 9/1944 | Schaaf | 241/46 R |

*Primary Examiner*—Granville Y. Custer, Jr.

*Attorney, Agent, or Firm*—Michael J. Striker

[57] ABSTRACT

Ashes and cinders which form during gasification of solid combustible substances are captured in a liquid body and form clinker granules of different sizes therein. A comminutor is arranged below the chamber in which the liquid body is accommodated so that the clinker granules descend into the comminutor in which the clinker granules are reduced to clinker particles having sizes equal to or smaller than a predetermined size. The comminutor may have two comminutor rollers rotated by respective drives in opposite directions about parallel horizontal axes. The drives are arranged outside and mounted on the comminutor housing, and are connected to the respective comminutor rollers by shafts penetrating through the comminutor housing and sealed by shaft seals. The comminutor may, in the alternative, include a single comminutor roller which cooperates with a grating tiltably mounted in the comminutor housing. A pivotable segment valve may be provided which controls the periodic discharge of the comminuted clinker from the comminutor housing into a discharge conduit or a water lock.

9 Claims, 5 Drawing Figures

COMMINUTOR FOR USE IN A GASIFYING INSTALLATION

BACKGROUND OF THE INVENTION

The present invention relates to an arrangement for gasifying solid combustible substances in general, and more particularly to an arrangement for comminuting clinker granules formed in a liquid bath from ashes and cinders formed during the gasifying operation and captured in a liquid body.

The process of gasifying solid combustible substances is well known and needs no elaboration. It needs to be mentioned however, that ashes and cinders form during the gasification of the solid combustible substances, which must be removed from the gas developing during the gasification of such substances. The gasification is usually performed by resorting to the utilization of oxygen-containing gases and/or water vapor. Depending on the temperatures prevailing in the interior of the gasifying vessel, the ashes and cinders will be either in solid or in a flowable form. To remove the ashes and cinders from the gas resulting from the gasifying process, it is already known to arrange a quenching liquid body at the bottom of the gasifying vessel, in which liquid body the ashes and cinders, descending due to their gravity, are captured, quenched, and form clinker granules or agglomerations. After such granulation, the clinker is periodically or continuously removed from the liquid body by means of conventional arrangements.

As a result of the cooling or quenching of the ashes and cinders in the liquid body and the attendant violent conditions, most of the clinker granulate is relatively small in size. However, as shown by experience, very often large granules or clinker agglomerations form in the liquid body, and it is very difficult to remove such relatively large granules or agglomerations from the liquid body.

SUMMARY OF THE INVENTION

Accordingly, it is a general object of the invention to avoid the disadvantages of the prior art.

More particularly, it is an object of the present invention to provide an arrangement which renders it possible to achieve a faultless removal of the clinker from the liquid body.

A further object of the present invention is to provide an arrangement of the above-mentioned type which is simple in construction, reliable in operation and inexpensive to manufacture.

A concomitant object of the present invention is to provide a comminuting arrangement which reduces the clinker to particles of sizes below a predetermined value prior to the discharge of the clinker from the gasifying installation.

In pursuance of these objects and others which will become apparent hereafter, one feature of the present invention resides, in an arrangement of the type having a gasifying vessel for gasifying solid combustible substances therein, briefly stated, in a combination comprising means defining a chamber at the bottom of the vessel for accommodating a liquid body in which ashes and cinders formed during the gasification are captured in the form of clinker; and means below the chamber for comminuting the clinker to particles of predetermined sizes. According to the present invention feeding means is arranged intermediate the chamber and the comminuting means and communicating therewith, the feeding means being operative for feeding the clinker from the chamber to the comminuting means. The feeding means may include a feeding hopper which defines a frusto-conical downwardly converging passage between the chamber and the comminuting means.

The arrangement of the present invention can be operated on a continuous basis. However, it is also possible to operate the arrangement on an intermittent basis, in that the clinker is accumulated upstream of the comminutor means and only periodically admitted or fed into the latter.

The comminuting means can be of a variety of different constructions. In one embodiment of the present invention, the comminuting means includes a comminutor housing, a pair of comminuting rollers mounted in the comminutor housing for rotation about respective parallel axes extending substantially horizontally and having respective shafts that penetrate through the communitor housing to the exterior thereof, sealing means between the shafts and the comminutor housing and operative for sealing the interface between the former and the latter, and respective drives located at the exterior of the comminutor housing and mounted on the latter and operative for rotating the comminuting rollers in opposite directions.

In a different embodiment of the present invention, the comminutor includes a comminutor housing, a single comminuting roller mounted in the comminutor housing for rotation about a substantially horizontal axis, a drive for rotating the comminuting roller about the above-mentioned axis, a grating mounted in the comminutor housing for movement toward and away from the comminuting roller, and means for biasing the grating toward the comminuting roller. The comminutor housing has an inlet for admitting the clinker descending by gravity from the chamber into the interior of the comminutor housing, and the grating is situated underneath the inlet, being operative for guiding clinker particles exceeding the above-mentioned size toward the comminuting roller while permitting clinker particles smaller than the above-mentioned size to penetrate therethrough. A particular advantage of this embodiment is to be seen in the fact that the small-size clinker particles fall through the grating and thus do not ever reach the comminuting roller, so that it is only the large-size clinker particles which are guided toward and acted upon by the comminuting rollers to be reduced in size by the latter.

The arrangement according to the present invention can be used in connection with gasifying vessels which operate within a wide range of operating conditions, such as temperature and pressure. Thus, the arrangement of the present invention can be used in connection with gasifying vessels which operate at pressures very close to the ambient pressure, such as gasifying vessels operated at pressures of only few hundred millimeters of water column above the ambient pressure. On the other hand, the arrangement of the present invention can also be used in connection with gasifying vessels which are operated at a substantial superatmospheric pressure, such as, for instance at 30 atmosphere gauge pressure.

Especially when the gasifying vessel is operated under the last-mentioned conditions, it is further advantageous, according to the present invention, to arrange a discharging container underneath the comminuting means and in communication therewith. Also, means may be provided for periodically discharging the comminuted clinker from the discharging container, such discharging means including a discharge opening at the bottom of the discharging container, and valve means for periodically opening and closing the discharge opening. The above-mentioned valve means may include a segment valve mounted in the discharging container at the discharging opening thereof for pivoting between a closing position in which it obstructs access of the comminuted clinker to the discharging opening, and an opening position it affords such access for discharging the comminuted clinker through the discharging opening, and means for periodically pivoting the valve between the above-mentioned positions thereof. The discharging opening may communicate with a water lock and thus the valve provides for accumulation of the comminuted clinker upstream of the water lock and only periodic admission of such comminuted clinker into the water lock.

Finally, according to a further aspect of the present invention, there is provided means for admitting ashes and clinker derived from parts of the gasifying arrangement different from the gasifying vessel into the feeding means. Such admitting means may include a conduit for a plurality of conduits, and/or a conveyor.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

DETAILED DISCUSSION OF THE PREFERRED EMBODIMENTS

Figures 1, 2:
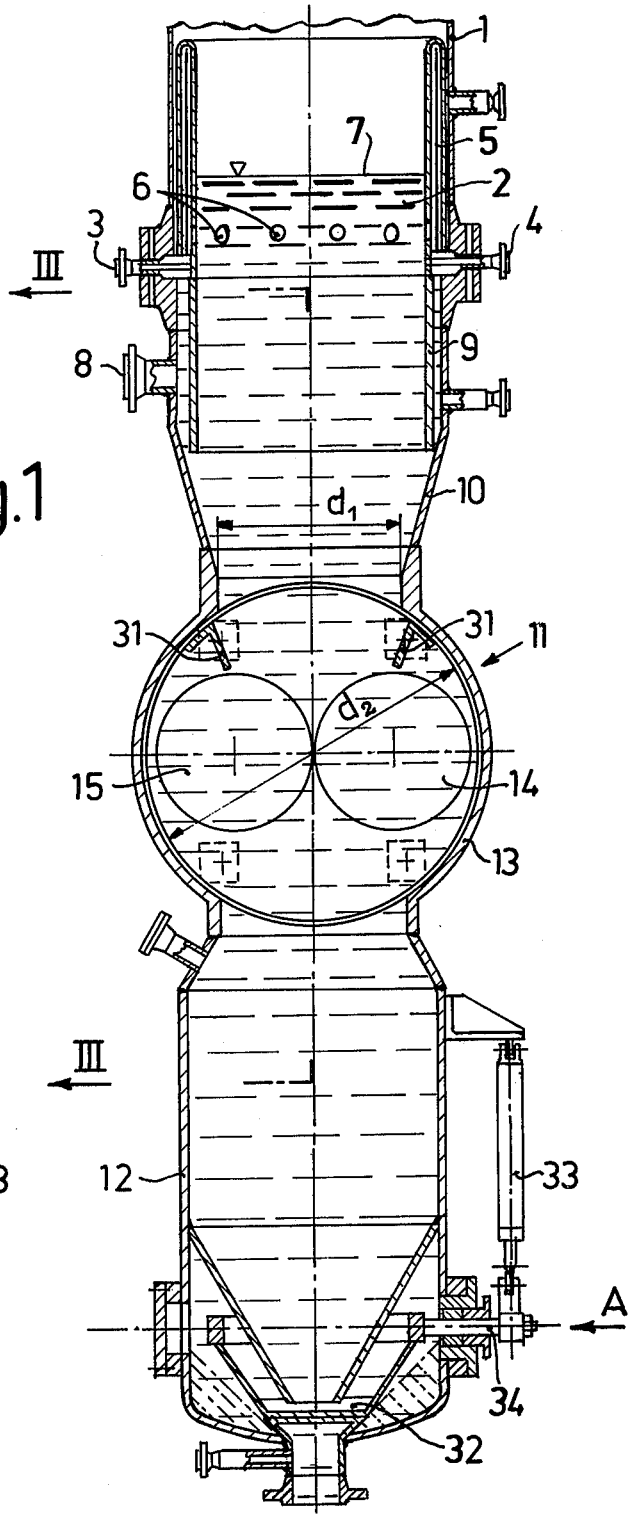
FIG. 1 is a vertical section through a first embodiment of the arrangement of the present invention.
FIG. 2 is a partially sectioned fragmentary view in the direction of the arrow A of FIG. 1.

Referring now to the drawing in detail, and first to FIG. 1 thereof, it may be seen therein that the reference numeral 1 has been used to designate an outlet of a conventional gasifying vessel which has been omitted from the drawing. The outlet 1 defines a chamber in which there is accommodated a body 2 of liquid, such as a body of water. Ashes and cinders which form during the gasification of solid combustible substances in the gasifying vessel, particularly flowable ashes and cinders, flow into the liquid body 2 due to their own gravity to be captured and quenched therein so that they form in the liquid body 2 extinguished clinker particles, granules or agglomerations. The liquid body 2 has an upper surface 7 which is maintained, in a conventional manner, at approximately the same elevation. To admit replenishment water or similar liquid into the outlet 1 to maintain the upper surface 7 at a predetermined elevation, there are provided inlet nipples 3 and 4 which communicate the interior of the outlet 1 with a non-illustrated source of the liquid. A cooling shield 5 is accommodated in the interior of the outlet 1 and is provided with openings 6 through which the liquid admitted through the nipples 3 and 4 flows from the exterior of the cooling shield into the interior thereof to replenish the body 2 of liquid therein. The openings 6 are located underneath the upper surface 7 of the liquid body 2 in the illustrated position in which the upper surface 7 is at the operating elevation. An outlet nipple 8 is provided, through which the liquid of the liquid body 2 can be withdrawn from the interior of the outlet 1, whenever necessary. The outlet nipple 8 is shielded by a protective sleeve 9 which prevents the penetration of the clinker granules toward the outlet nipple 8.

A feeding hopper 10 is connected to the outlet 1 by a conventional flange connection, and a comminuting device designated in toto with the reference numeral 11, and a discharge container 12, are arranged downstream of the feeding hopper 10 and are both filled with the liquid body 2.

The comminuting device 11 includes a comminutor housing 13, and two comminuting rollers 14 and 15 are accommodated in the interior of the comminutor housing 13, being mounted therein in a manner which will be presently described for rotation in opposite directions about respective parallel, substantially horizontal axes.

Figure 3:
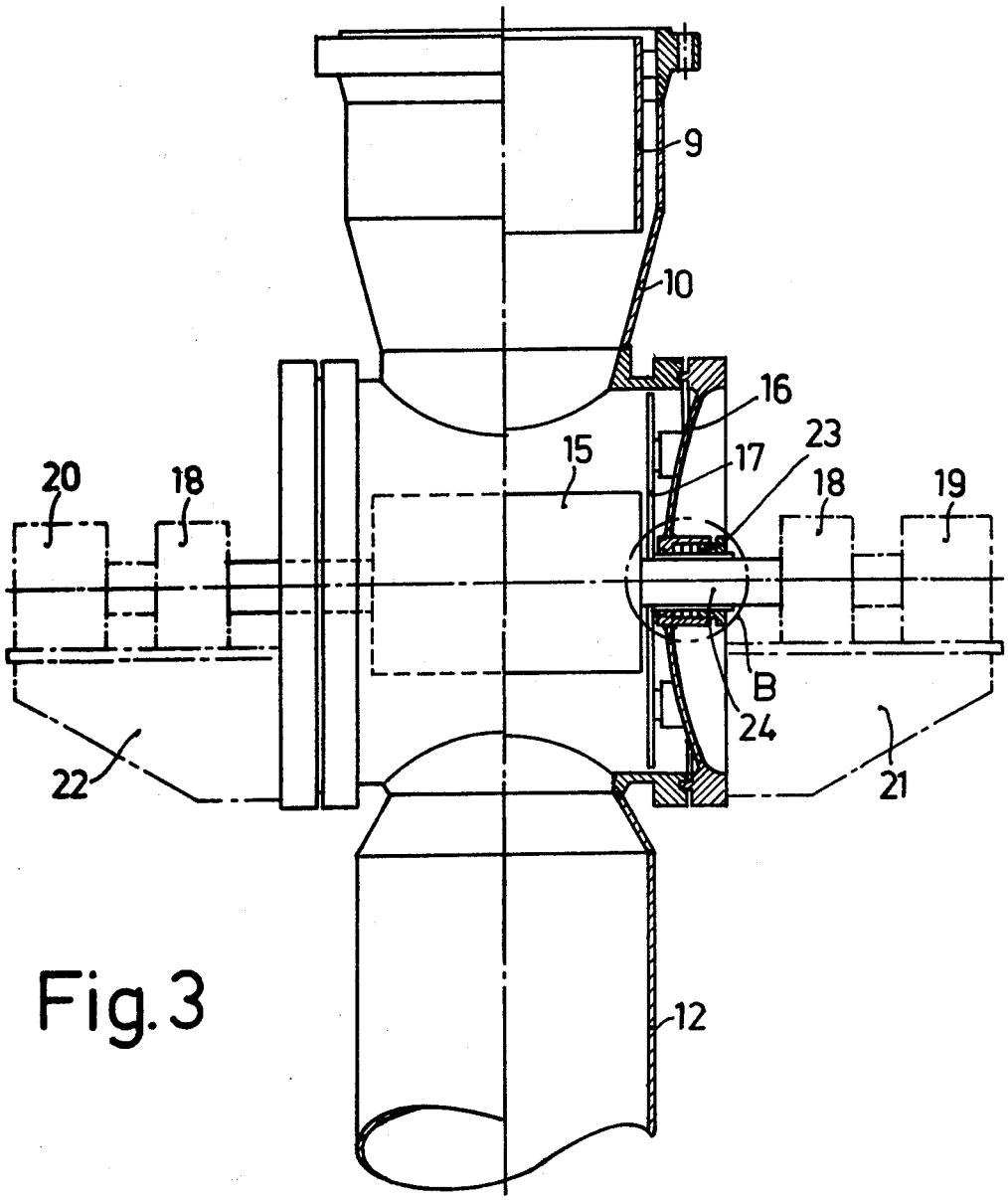
FIG. 3 is a partial section taken on line III—III of FIG. 1.

Referring now to FIG. 3, it may be seen therein that the comminutor housing 13 has a supporting and assembling lid 16 at each of its sides. The lid 16 is covered, at the interior thereof, by a closing plate 17 which prevents penetration of the clinker toward the lid 16. The comminuting rollers 15, 14 are supported in bearings 18 located at the respective exteriors of the lids 16, and each of the comminuting rollers 14, 15 is individually driven in rotation by a separate drive 19 or 20, to be independent from one another. In order to assure a faultless centering of the comminuting rollers 14, 15, the bearings 18 and the drives 19 and 20 are supported on respective supports 21, 22 which, in turn, are rigidly mounted on the respective lids 16.

Figure 4:
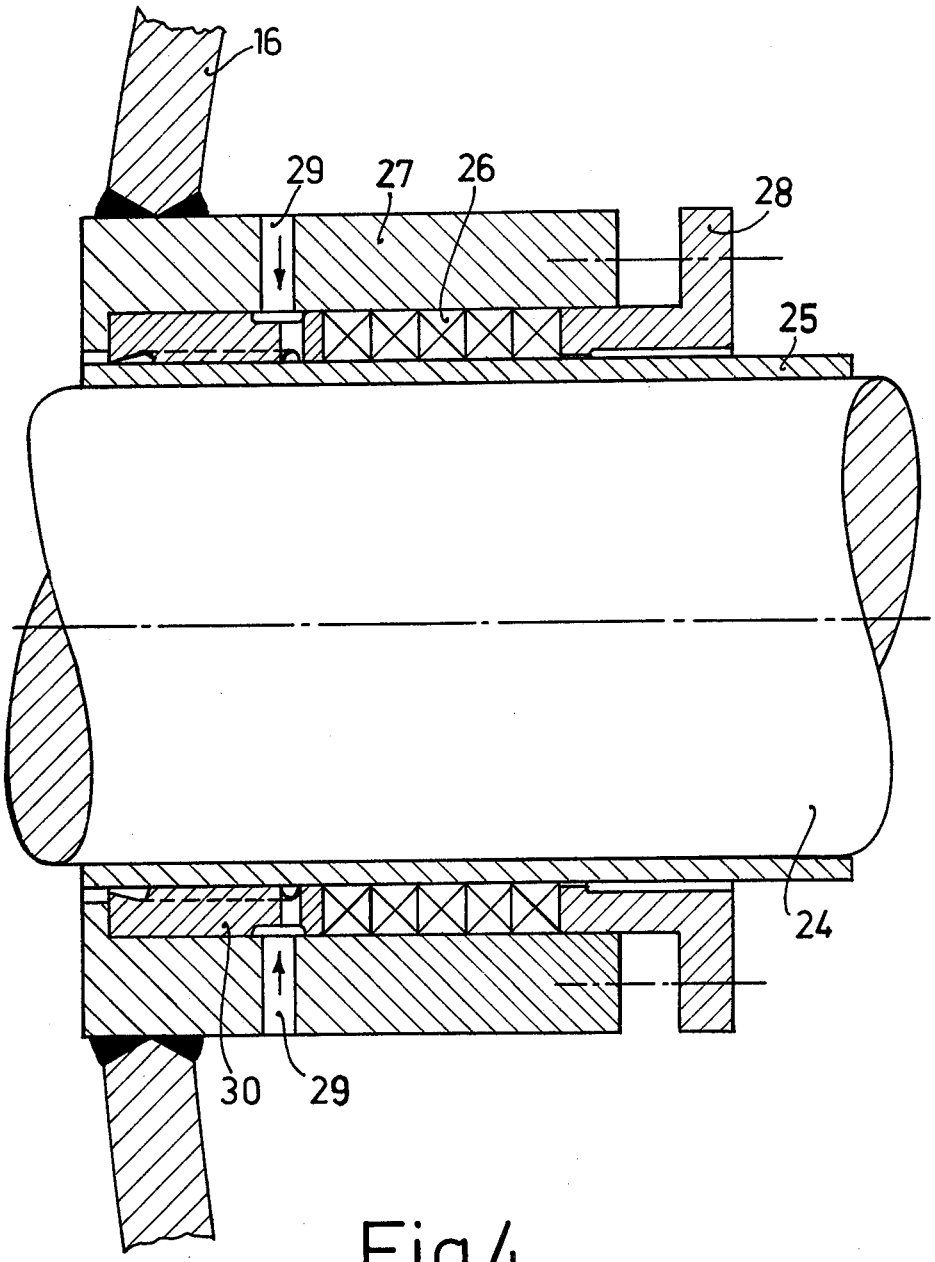
FIG. 4 is an enlarged sectional view of a detail B of FIG. 3.

FIG. 4 illustrates in more detail how the respective shaft 24 which penetrates through the lid 16 of the housing 13 is sealed. The reference numeral 23 (see FIG. 3) has been used to indicate a seal including a plurality of components which will now be described. In the region of its penetration through the lid 16, the shaft 24 has a protective sleeve 25. Sealing or packing elements 26 are arranged around the protective sleeve 25 and are accommodated in a packing sleeve 27. A gland 28 has a portion which is accommodated in the interior of the packing sleeve 27 and abuts against the terminal packing element 26 to compress the packing element 26 and thus press the same into sealing contact with the protective sleeve 25 and the packing sleeve 27. Conventional screws or similar tightening means, indicated in FIG. 4 only by their axes, are used for displacing the gland 28 into the interior of the packing sleeve 27 to thereby exert the necessary compression force on the packing elements 26.

One or more fluid seal arrangement 30 are accommodated in the interior of the packing sleeve 27. Water or liquid inlets 29 communicate with the respective liquid seal arrangements 30 and are connected, in a non-illustrated conventional manner, with a source of water or liquid at superatmospheric pressure. The water or liquid conveyed to the inlets 29 is always at a pressure exceeding that prevailing in the gasifying vessel and also in the interior of the comminuting device 11. The liquid seal arrangement 30 has at least one labyrinthine passage through which the liquid admitted through the inlets 29 flows into the interior of the comminuting device 11, thereby preventing contaminated liquid present in the interior of the comminuting device 11 from entering the interior of the packing sleeve 27 and from reaching and contaminating the sealing or packing elements 26.

Coming now back to FIG. 1 it may be seen therein that the comminuting device 11 has an inlet which has a diameter $d_1$, while the internal chamber of the comminuting device 11, in which the comminuting rollers 14, 15 are accommodated, has a diameter $d_2$. The proportion of the diameter $d_1$ to the diameter $d_2$ is of a particular significance for an advantageous feeding of the clinker from the hopper 10 to the comminuting rollers 14 and 15. The abovementioned plates 17 serve to guide the clinker in the comminuting device 11, in cooperation with guides 31 extending transversely to the plates 17 and between the same.

The clinker which is comminuted in the comminuting device 11 by the action of the comminuting rollers 14 and 15 falls into the discharging container 12, is temporarily retained therein, and then discontinuously discharged from the discharging container 12 through a discharging outlet located at the bottom of the discharging container 12. The operation of the discharging container 12, and particularly the discharge of the accumulated clinker therefrom, is controlled by the operating cycle of a water lock which is arranged downstream of the discharging opening of the discharging container 12.

In order to assure an unproblematical discharge of the comminuted clinker from the discharging container, a segment valve 32 illustrated in FIGS. 1 and 2 is provided which obstructs the advancement of the clinker into the discharge opening of the discharging container 12 when it is desired to accumulate the clinker in the latter. The valve 32 is operated by a drive 33 in accordance with the switching rhythm of the non-illustrated conventional water lock. A shaft 34 on which the valve 32 is mounted for joint pivoting therewith can be sealed in a manner similar to that described above in connection with the sealing of the shaft 24.

Figure 5:
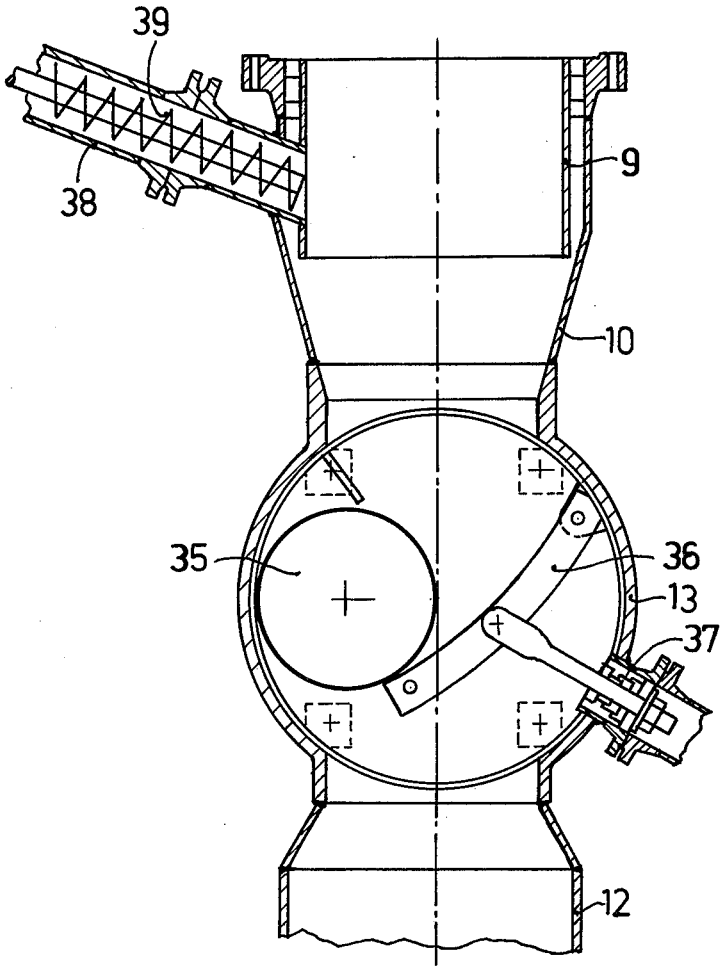
FIG. 5 is a partial view similar to FIG. 1 but of a different embodiment of the arrangement of the present invention.

FIG. 5 illustrates a further embodiment of the comminuting device 11 of the present invention. In this embodiment there is provided only a single comminuting roller 35, and a tiltable grating 36 guides the clinker to be comminuted toward the single comminuting roller 35. The grating 36 is mounted in the interior of the comminuting device 11 for tilting, and a compression spring 37 urges the grating 36 toward the comminuting roller 35. The grating or sieve 36 is so constructed that smaller clinker particles or granules can fall therethrough directly into a discharging container 12, so that it is only the larger clinker granules or agglomerations which are guided by the grating or sieve 36 toward the single comminuting roller 35.

Finally, the reference numeral 38 designates an inlet conduit which communicates with the feeding hopper 10. Ashes or cinders which form in parts of the gasifying installation different from the gasifying vessel proper can be introduced into the feeding hopper 10 through the conduit 38. As an example, such additional ashes may come from a cooling arrangement arranged in the path of flow of the gas developed in the gasifying vessel, downstream of the latter. If necessary, a conveyor, such as a screw conveyor 39 may be provided in the conduit 38.

It will be understood that each of the elements described above, or two or more together, may also find a useful application in other types of constructions differing from the types described above.

While the invention has been illustrated and described as embodied in a comminutor for use in a gasifying installation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an arrangement of the type having a gasifying vessel for gasifying solid combustible substances therein with an attendant development of ashes and cinders, a combination comprising means defining a chamber at the bottom of the gasifying vessel; comminuting means situated below said chamber and communicating therewith; and means for maintaining in said chamber and in said comminuting means a body of a liquid which captures the ashes and cinders in the form of clinker which gravitationally descends through said liquid body from said chamber toward said comminuting means to be comminuted by the latter to particles of at most a predetermined size, including means for supplying the liquid into said chamber, means for discharging at least some of the liquid from said chamber including at least one outlet port located upwardly of said comminuting means, and shielding means in said chamber for preventing the clinker from reaching and entering said outlet port.

2. A combination as defined in claim 1, wherein said comminuting means includes a feeding hopper defining a frusto-conical downwardly converging passage.

3. A combination as defined in claim 1, the ashes and clinker being derived from said gasifying vessel; and further comprising means for admitting into said chamber additional ashes and clinker derived from an extraneous source.

4. A combination as defined in claim 1, wherein said comminuting means includes a comminutor housing, a pair of comminuting rollers mounted in said comminutor housing for rotation about respective parallel axes extending substantially horizontally and having respective shafts that penetrate through said comminutor housing to the exterior thereof, sealing means between said shafts and said comminutor housing and operative for sealing the interface between the former and the latter, and respective drives located at said exterior of said comminutor housing and mounted on the latter and operative for rotating said comminuting rollers in opposite directions.

5. A combination as defined in claim 1, wherein said comminuting means includes a comminutor housing, a single comminuting roller mounted in said comminutor housing for rotation about a substantially horizontal axis, a drive for rotating said comminuting roller about said axis, a grating mounted in said comminutor housing for movement toward and away from said comminuting roller, and means for biasing said grating toward said comminuting roller.

6. A combination as defined in claim 5, wherein said comminutor housing has an inlet for admitting the clinker descending by gravity from said chamber into the interior of said comminutor housing; and wherein said grating is situated underneath said inlet and is operative for guiding clinker particles exceeding said size toward said comminuting roller while permitting clinker particles smaller than said size to penetrate therethrough.

7. A combination as defined in claim 1; and further comprising a discharging container arranged underneath and communicating with said comminuting means.

8. A combination as defined in claim 7, and further comprising means for periodically discharging the comminuted clinker from said discharging container, including a discharge opening at the bottom of said discharging container, and valve means for periodically opening and closing said discharge opening.

9. A combination as defined in claim 8, wherein said valve means includes a segment valve mounted in said discharging container at said discharging opening for pivoting between closing position in which it obstructs access of the comminuted clinker to said discharging opening, and an opening position in which it affords such access for discharging the comminuted clinker through said discharging opening, and means for periodically pivoting said valve between said positions thereof.

* * * * *